US006318282B1

(12) United States Patent
Tsai

(10) Patent No.: US 6,318,282 B1
(45) Date of Patent: Nov. 20, 2001

(54) THREAD TRIMMING DEVICE FOR A SPREADER THREAD IN A SEWING MACHINE

(75) Inventor: Wen-Chen Tsai, Tu-Cheng (TW)

(73) Assignee: Kaulin Mfg. Co., Ltd., Taipei (TW)

( * ) Notice: Subject to any disclaimer, the term of this patent is extended or adjusted under 35 U.S.C. 154(b) by 14 days.

(21) Appl. No.: 09/724,601

(22) Filed: Nov. 28, 2000

(30) Foreign Application Priority Data

Jul. 12, 2000 (TW) ..... 89211957

(51) Int. Cl.[7] ..... D05B 65/00
(52) U.S. Cl. ..... 112/286
(58) Field of Search ..... 112/287, 285, 112/298, 292, 295, 286, 200, 253

(56) References Cited

U.S. PATENT DOCUMENTS 3,901,171 * 8/1975 Rosa ..... 112/286
4,436,044 * 3/1984 Nordstrom et al. ..... 112/286
4,550,672 * 11/1985 Kastrup ..... 112/253 X
5,127,350 * 7/1992 Okada et al. ..... 112/295 X

FOREIGN PATENT DOCUMENTS 71925 11/1985 (TW) .

* cited by examiner

*Primary Examiner*—Ismael Izaguirre

(57) ABSTRACT

The present invention comprises an air cylinder which is driven by compressed air. When sewing with a spreader thread, the air cylinder drives a movable catcher and a fixed cutter to cut off a spreader thread, which is then clamped by a spring plate to facilitate the next sewing operation. When sewing without a spreader thread, compressed air is used through an air passage to blow the free end of the needle thread cut off by an under trimming mechanism away from the underside of the presser foot after the presser foot is lifted at the end of a sewing operation to facilitate the next sewing operation. The air cylinder in the present invention may also be replaced by an electromagnetic relay, which, when powered up, stretches and retracts the central shaft to drive a movable catcher and a fixed cutter and thereby cut off the spreader thread.

2 Claims, 6 Drawing Sheets

THREAD TRIMMING DEVICE FOR A SPREADER THREAD IN A SEWING MACHINE

BACKGROUND OF INVENTION

The present invention relates to a thread trimming device in a sewing machine, particularly to a thread trimming device for capturing and cutting a spreader thread in a sewing machine, which is also capable of blowing the needle thread cut off by the under trimming mechanism away from the underside of the presser foot after the presser foot is lifted at the end of a sewing operation in order to facilitate the next sewing operation.

DESCRIPTION OF PRIOR ART

In order to increase the sewing speed and to improve the convenience for users, an industrial sewing machines is usually installed with an automatic thread trimming device. For spreader threads, there are specific thread trimming devices, such as disclosed in ROC (Taiwan) Publication No. 71925 "Device for cutting a cover thread in a multi-needle sewing machine". Such a conventional device for cutting a spreader thread (cover thread) usually has a complex structure with large dimensions; moreover, when not using a spreader thread trimmer (for example, when sewing without a spreader thread), an additional blowing means is further required for blowing away the free end of the needle thread cut off by the under trimming mechanism in order to facilitate the next sewing operation, which not only increases the complexity and the difficulty in operation but also substantially raises the cost for manufacture and maintenance. Therefore, it has become a task to provide a device for trimming a spreader thread when sewing with a spreader thread and for blowing away the free end of the needle thread cut off by the under trimming mechanism when sewing without a spreader thread.

SUMMARY OF INVENTION

The object of the present invention is to provide a thread trimming device for a spreader thread, which is capable of not only cutting off a spreader thread, but also blowing away the free end of the needle thread cut off by the under trimming mechanism.

Another object of the present invention is to provide a thread trimming device for a spreader thread, which has a simple structure and is easily manufactured and maintained.

A further object of the present invention is to overcome the drawback of a conventional sewing machine having separate spreader tread trimmer and blowing means, and to provide a spreader thread trimming device which can be used to cut off a spreader thread when sewing with a spreader thread and to blow away the needle thread when sewing without a spreader thread.

The present invention comprises an air cylinder which is driven by compressed air. When sewing with a spreader thread, the air cylinder drives a movable catcher and a fixed cutter to cut off a spreader thread, which is then clamped by a spring plate to facilitate the next sewing operation. When sewing without a spreader thread, compressed air is used through an air passage to blow the free end of the needle thread cut off by an under trimming mechanism away from the underside of the presser foot after the presser foot is lifted at the end of a sewing operation to facilitate the next sewing operation. The air cylinder in the present invention may also be replaced by an electromagnetic relay, which, when powered up, stretches and retracts the central shaft to drive a movable catcher and a fixed cutter and thereby cut off the spreader thread.

DETAILED DESCRIPTION OF INVENTION

Please refer to FIGS. 1 to 15.

Figure 2:
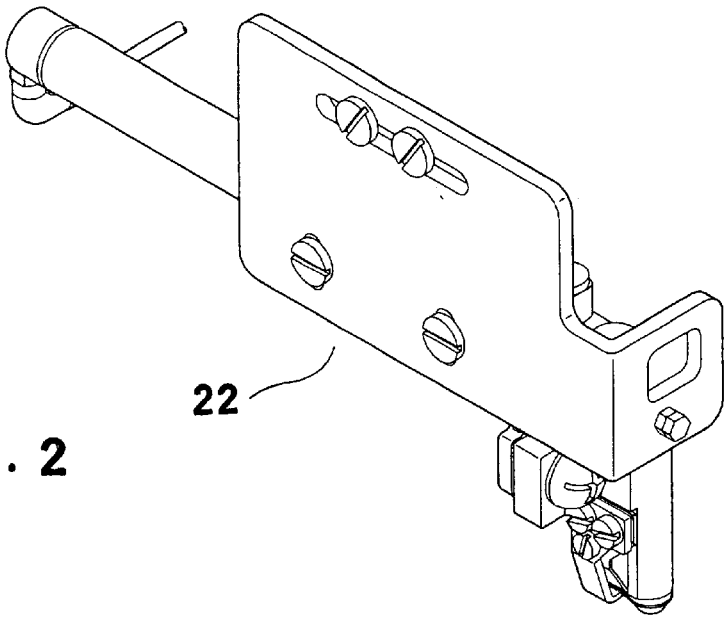
FIG. 2 is a perspective view of the thread trimming device for a spreader thread in a sewing machine according to the present invention.
Figure 1:
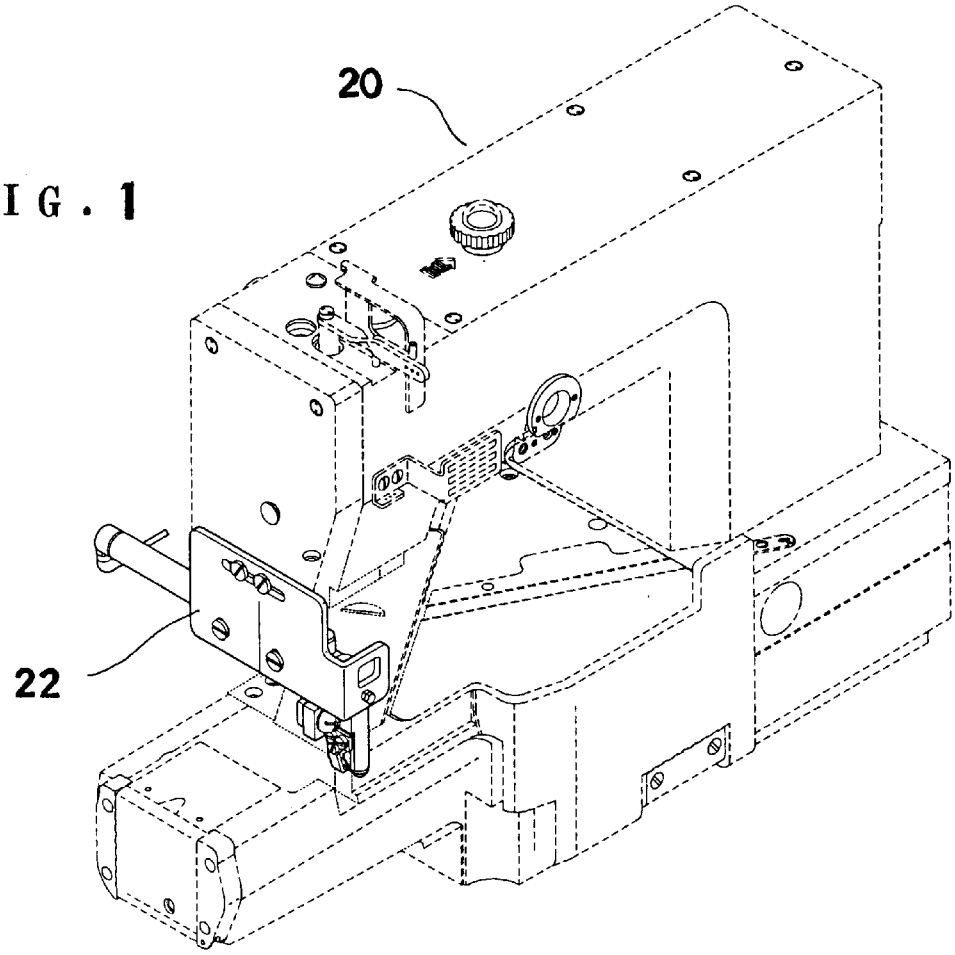
FIG. 1 is a schematic view showing the thread trimming device for a spreader thread in a sewing machine according to the present invention, being installed on a sewing machine.
Figure 3:
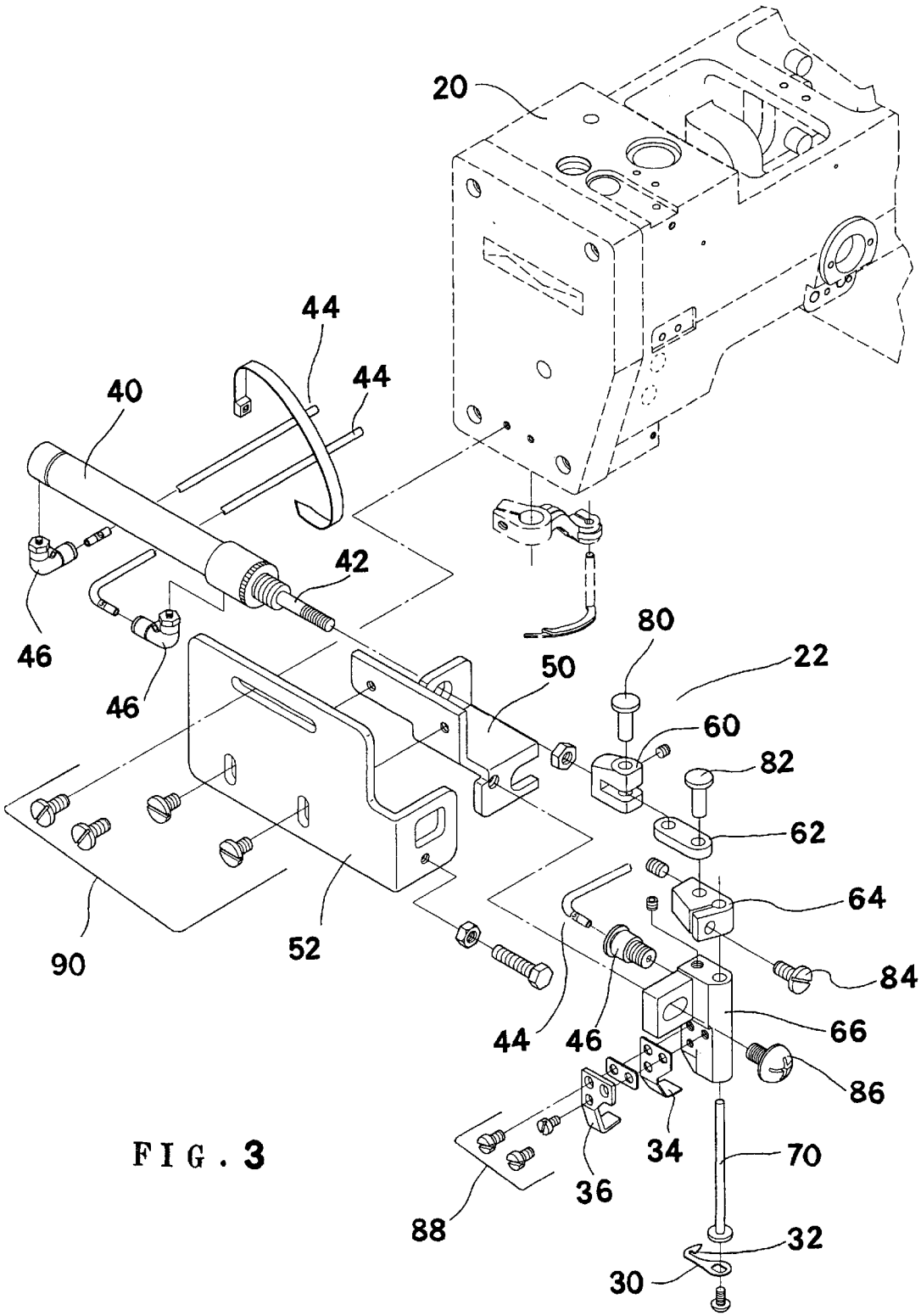
FIG. 3 is an exploded view of the thread trimming device for a spreader thread in a sewing machine according to the present invention.
Figure 4:
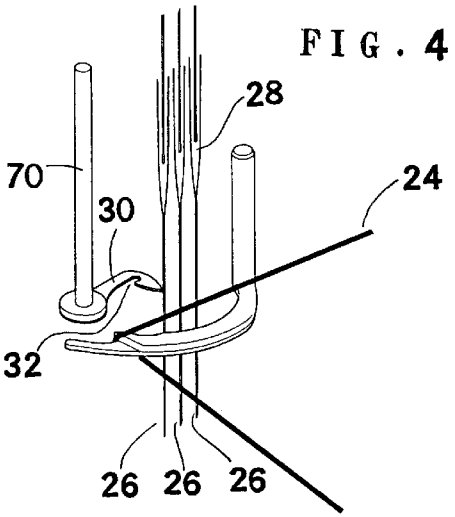
FIGS. 4 to 9 are schematic views showing the consecutive operations of the thread trimming device for a spreader thread in a sewing machine according to the present invention.
Figure 5:
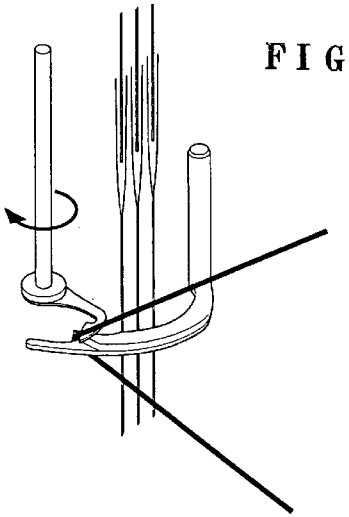
Figure 6:
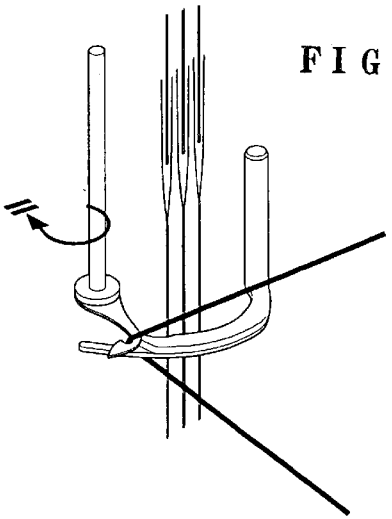
Figure 7:
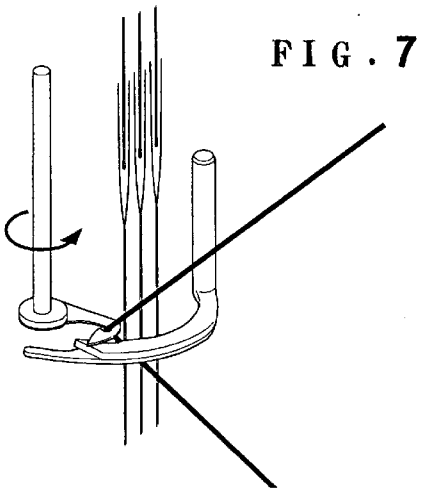

The thread trimming device 22 for a spreader thread 24 in a sewing machine 20 according to the present invention comprises an air cylinder 40, which is fixed to a first mount 50 and is connected with at least one tube joint 46 and one air tube 44, having a shaft 42 provided at one end (FIG. 3). It should be noticed that, although the air cylinder 40 shown in the drawings (such as FIG. 3) is provided with two tube joints 46 and two air tubes 44 (one for blowing and the other for suction), yet the number of such tube joints 46 and air tubes 44 may vary with the structure of the air cylinder, which is not a key point of the subject application. The shaft 42 of the air cylinder 40 is coupled to a first connector 60. The first connector 60 is coupled to a second connector 62 by using a first bolt 80. The second connector 62 is coupled to a third connector 64 by using a second bolt 82. The third connector 64 is coupled to a fourth connector 66 and a rotating shaft 70 passing through the fourth connector 66 by using a third bolt 84. The fourth connector 66 is coupled to a first mount 50 by using a fourth bolt 86 (as shown in FIG. 3). The bottom of the rotating shaft 70 is coupled with a movable catcher 30 having a recess 32 at the front end (see FIGS. 3 to 9). A fixed cutter 36 and a spring plate 34 are coupled to the lower portion of the fourth connector 66 by a fifth bolt 88, with an interval between the fixed cutter 36 and the spring plate 34 suitable for the movable catcher 30 to pass through (see FIGS. 3 to 11). An air passage 74 is provided in the fourth connector 66, with one opening of the air passage 74 near the fixed cutter 36 and the spring plate 34 and the other opening connected to the tube joint 46 and the air tube 44 (see FIG. 3 and FIGS. 12 to 15). A second mount 52 is used for locking the first mount 50 onto the sewing machine 20 by a sixth bolt 90 (see FIGS. 1 to 3).

Figure 8:
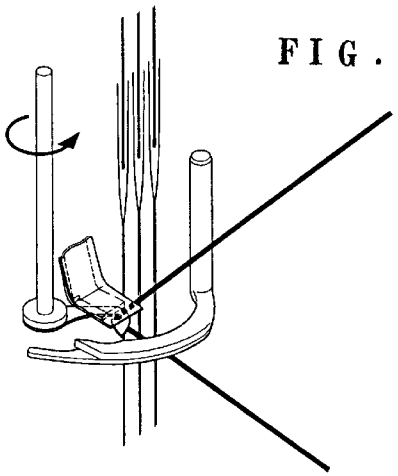
Figure 9:
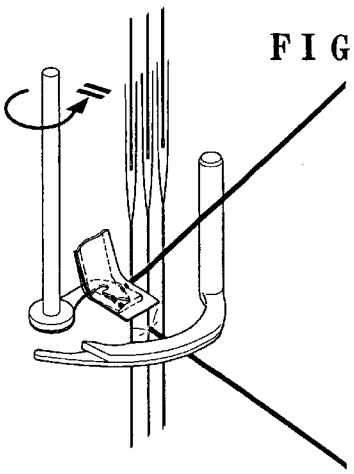
Figure 11:
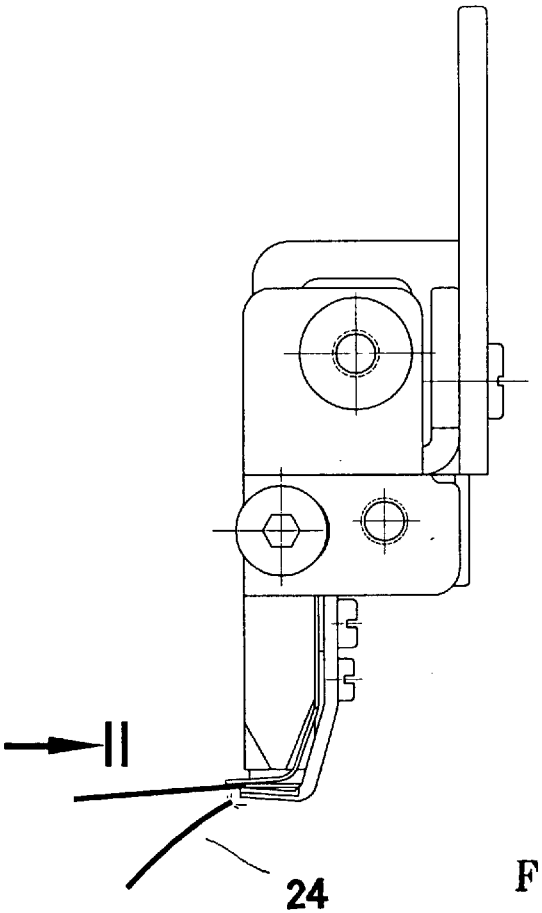
FIGS. 10 and 11 are side views showing the operations for cutting off the free end by the thread trimming device for a spreader thread in a sewing machine according to the present invention (respectively corresponding to FIGS. 8 and 9)
Figure 10:
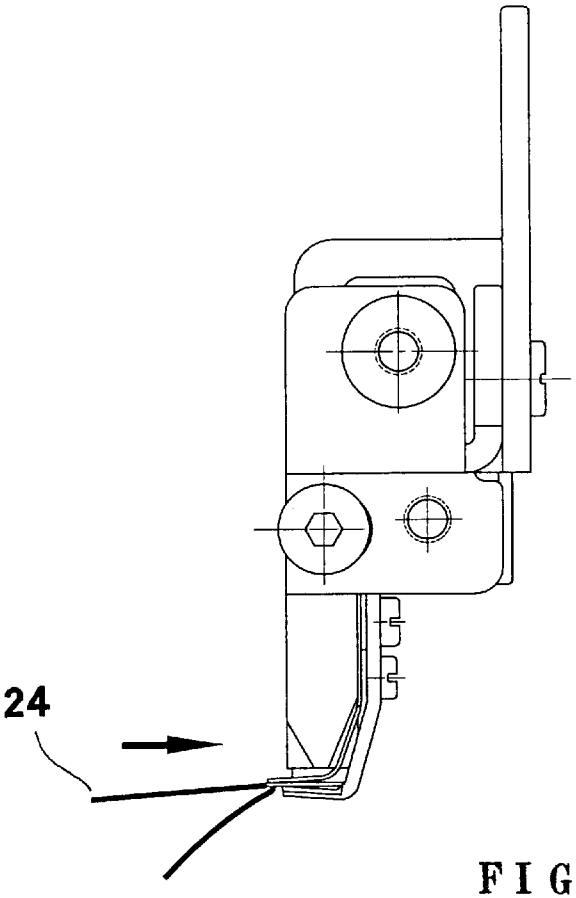
Figure 13:
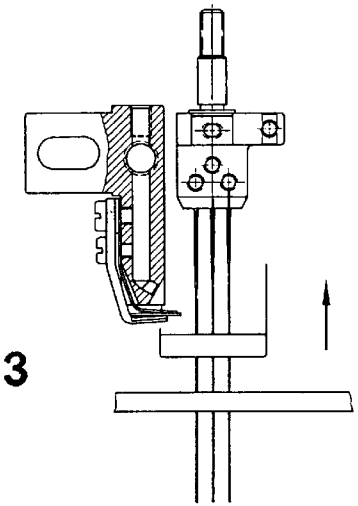
FIGS. 12 to 15 are schematic views showing the consecutive operations for blowing the free end away by the thread trimming device for a spreader thread in a sewing machine according to the present invention.
Figure 15:
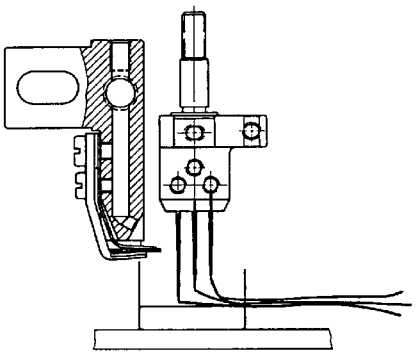
Figure 12:
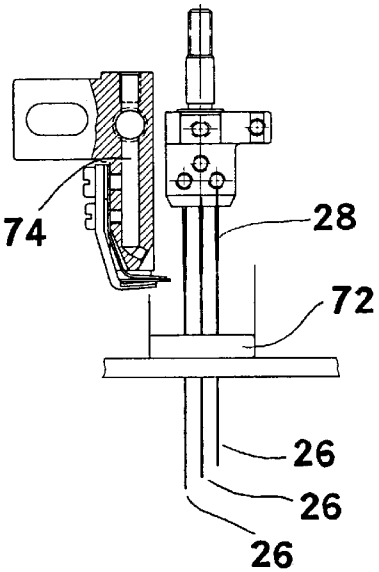
Figure 14:
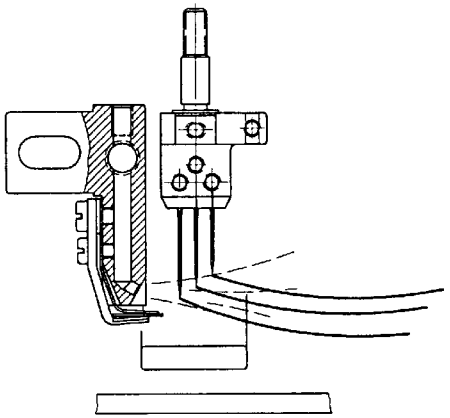

Thereby, when the compressed air provided by an air compressing motor (not shown) drives the air cylinder 40 through the air tube 44, the shaft 42 of the air cylinder 40 begins to function and sequentially drives the first connector 60, the second connector 62 and the third connector 64, and finally rotates the rotating shaft 70 to start the movable catcher 30. The movable catcher 30 sticks out to grasp and pull back the spreader thread 24 by the recess 32. The spreader thread 24 is then cut off by the fixed cutter 36 and the movable catcher 30, and thereafter is clamped between the fixed cutter 36 and the spring plate 34 in order to facilitate the next sewing operation. The consecutive operations for cutting off the thread are schematically shown in FIGS. 4 to 9; the side views corresponding to FIG. 8 and FIG. 9 are respectively shown in FIG. 10 and FIG. 11. Furthermore, when sewing without a spreader thread 24, the needle thread 26 is cut off by an under trimming mechanism (not shown) at the end of the sewing operation. After the presser foot 72 is lifted, compressed air is introduced through the air tube 44 into the air passage 74 in the fourth connector 66 and blows away the free end of the needle thread 26 to facilitate the next sewing operation. The consecutive operations for blowing away the free end are schematically shown in FIGS. 12 to 15.

Figure 16:
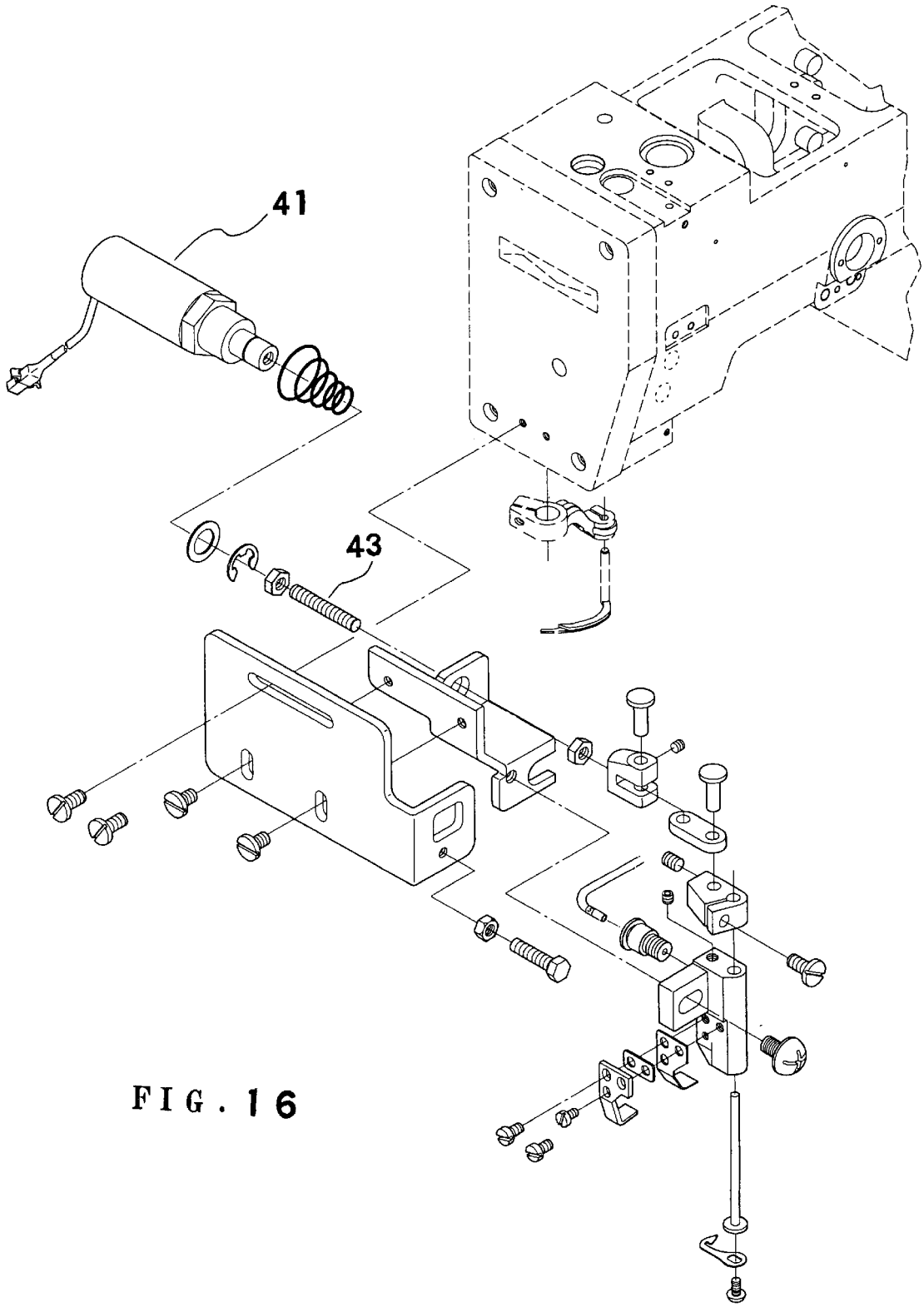
FIG. 16 is an exploded view of the second embodiment of the thread trimming device for a spreader thread in a sewing machine according to the present invention.

FIG. 16 illustrates the second embodiment of the present invention. The second embodiment is the same as the first embodiment shown in FIGS. 1 to 3 except that the air cylinder 40 is replaced by an electromagnetic relay 41. The electromagnetic relay 41 is fixed to a first mount 50 and is provided with a central shaft 43 which is coupled to a first connector 60. When the electromagnetic relay 41 is powered up to stretch and retract the central shaft 43, the central shaft 43 begins to function and sequentially drives the first connector 60 and other elements to cut off the spreader thread 24. Since other elements in the second embodiment are the same as those in the first embodiment, the thread cutting operations are the same as those shown in FIGS. 4 to 15, and the reference numerals are also the same, hence the description of the operation is omitted.

What is claimed is:

1. A thread trimming device for a spreader thread in a sewing machine, comprising:

an air cylinder fixed to a first mount, connected with at least one tube joint and one air tube and having a shaft at one end;

the shaft of the air cylinder being coupled to a first connector, the first connector being coupled to a second connector by using a first bolt, the second connector being coupled to a third connector by using a second bolt, the third connector being coupled to a fourth connector and a rotating shaft passing through the fourth connector by using a third bolt, the fourth connector being coupled to a first mount by using a fourth bolt;

the bottom of the rotating shaft being coupled with a movable catcher having a recess at the front end;

a fixed cutter and a spring plate being coupled to the lower portion of the fourth connector by a fifth bolt, with an interval between the fixed cutter and the spring plate suitable for the movable catcher to pass through;

an air passage being provided in the fourth connector, with one opening of the air passage near the fixed cutter and the spring plate and the other opening connected to the tube joint and the air tube; and a second mount used for locking the first mount onto the sewing machine by a sixth bolt, thereby, when the compressed air drives the air cylinder through the air tube, the shaft of the air cylinder begins to function and sequentially drives the first connector, the second connector and the third connector, and finally rotates the rotating shaft to start the movable catcher, and the movable catcher sticks out to grasp and pull back the spreader thread by the recess, so that the spreader thread is cut off by the fixed cutter and the movable catcher, and thereafter is clamped between the fixed cutter and the spring plate in order to facilitate the next sewing operation, and thereby, when sewing without a spreader thread, the needle thread is cut off at the end of the sewing operation, and after the presser foot is lifted, compressed air is introduced through the air tube into the air passage in the fourth connector and blows away the free end of the needle thread to facilitate the next sewing operation.

2. A thread trimming device for a spreader thread in a sewing machine, comprising:

an electromagnetic relay fixed to a first mount and provided with a central shaft;

the central shaft of the electromagnetic relay being coupled to a first connector, the first connector being coupled to a second connector by using a first bolt, the second connector being coupled to a third connector by using a second bolt, the third connector being coupled to a fourth connector and a rotating shaft passing through the fourth connector by using a third bolt, the fourth connector being coupled to a first mount by using a fourth bolt;

the bottom of the rotating shaft being coupled with a movable catcher having a recess at the front end;

a fixed cutter and a spring plate being coupled to the lower portion of the fourth connector by a fifth bolt, with an interval between the fixed cutter and the spring plate suitable for the movable catcher to pass through;

an air passage being provided in the fourth connector, with one opening of the air passage near the fixed cutter and the spring plate and the other opening connected to the tube joint and the air tube; and a second mount used for locking the first mount onto the sewing machine by a sixth bolt, thereby, when the electromagnetic relay is powered to stretch and retract the central shaft, the central shaft of the electromagnetic relay begins to function and sequentially drives the first connector, the second connector and the third connector, and finally rotates the rotating shaft to start the movable catcher, and the movable catcher sticks out to grasp and pull back the spreader thread by the recess, so that the spreader thread is cut off by the fixed cutter and the movable catcher, and thereafter is clamped between the fixed cutter and the spring plate in order to facilitate the next sewing operation, and thereby, when sewing without a spreader thread, the needle thread is cut off at the end of the sewing operation, and after the presser foot is lifted, compressed air is introduced through the air tube into the air passage in the fourth connector and blows away the free end of the needle thread to facilitate the next sewing operation.

* * * * *